US009656835B2

(12) United States Patent
Kitazawa

(10) Patent No.: US 9,656,835 B2
(45) Date of Patent: May 23, 2017

(54) ELEVATOR CAR DOOR LOCKING APPARATUS

(71) Applicant: MITSUBISHI ELECTRIC CORPORATION, Chiyoda-ku (JP)

(72) Inventor: Masaya Kitazawa, Chiyoda-ku (JP)

(73) Assignee: MITSUBISHI ELECTRIC CORPORATION, Chiyoda-ku (JP)

( * ) Notice: Subject to any disclaimer, the term of this patent is extended or adjusted under 35 U.S.C. 154(b) by 0 days.

(21) Appl. No.: 14/894,675

(22) PCT Filed: Jul. 19, 2013

(86) PCT No.: PCT/JP2013/069660
§ 371 (c)(1),
(2) Date: Nov. 30, 2015

(87) PCT Pub. No.: WO2015/008386
PCT Pub. Date: Jan. 22, 2015

(65) Prior Publication Data
US 2016/0130116 A1 May 12, 2016

(51) Int. Cl.
*B66B 13/18* (2006.01)
*B66B 13/12* (2006.01)

(52) U.S. Cl.
CPC ..... *B66B 13/18* (2013.01); *B66B 13/12* (2013.01)

(58) Field of Classification Search
CPC ..... B66B 13/18; B66B 13/12; B66B 13/20; B66B 13/02; B66B 13/08; B66B 13/10
USPC ..... 187/335
See application file for complete search history.

(56) References Cited

U.S. PATENT DOCUMENTS 4,947,964 A * 8/1990 Husmann ..... B66B 13/12 187/314
7,077,242 B2 * 7/2006 Cocher ..... B66B 13/12 187/330
7,681,695 B2 * 3/2010 Christen ..... B66B 13/12 187/319

(Continued)

FOREIGN PATENT DOCUMENTS

CN 101132983 A 2/2008
CN 201842558 U 5/2011

(Continued)

OTHER PUBLICATIONS

International Search Report issued Oct. 29, 2013 in PCT/JP2013/069660 filed Jul. 19, 2013.

(Continued)

*Primary Examiner* — Michael Riegelman
(74) *Attorney, Agent, or Firm* — Oblon, McClelland, Maier & Neustadt, L.L.P.

(57) ABSTRACT

In an elevator car door locking apparatus, a doorstop-side blade is disposed on a car door by a linking mechanism, and is displaceable horizontally between a locked position, and an unlocked position that is further away from a door pocket than the locked position. A balance weight is disposed on an opposite side of the pivoting shaft of the link from the doorstop-side blade. The doorstop-side blade comes into contact with a landing door engaging member and displaces, and the balance weight also displaces away from the doorstop-side blade, due to the car door moving toward the door pocket side when a car is in position at a floor.

4 Claims, 13 Drawing Sheets

(56) References Cited

U.S. PATENT DOCUMENTS

| | | | | |
|---|---|---|---|---|
| 8,607,937 | B2 * | 12/2013 | Gilli | B66B 13/12 187/319 |
| 2005/0126860 | A1 * | 6/2005 | Rennetaud | B66B 13/12 187/319 |
| 2005/0139429 | A1 * | 6/2005 | Bisang | B66B 13/12 187/319 |
| 2007/0295564 | A1 * | 12/2007 | Someya | B66B 13/20 187/319 |
| 2012/0118676 | A1 * | 5/2012 | Utsunomiya | B66B 13/12 187/330 |
| 2012/0298453 | A1 * | 11/2012 | Fujii | B66B 13/12 187/330 |
| 2015/0203329 | A1 * | 7/2015 | Zappa | B66B 13/125 187/319 |

FOREIGN PATENT DOCUMENTS

| | | |
|---|---|---|
| JP | 59 30638 | 7/1984 |
| JP | 8 59153 | 3/1996 |
| JP | 9 272681 | 10/1997 |
| JP | 2001 253671 | 9/2001 |
| JP | 2008 528399 | 7/2008 |
| JP | 2011 73862 | 4/2011 |

OTHER PUBLICATIONS

Combined Office Action and Search Report issued Aug. 30, 2016 in Chinese Patent Application No. 201380078349.0 (with partial English translation and English translation of Categories of Cited Documents).

* cited by examiner

ELEVATOR CAR DOOR LOCKING APPARATUS

TECHNICAL FIELD

The present invention relates to an elevator car door locking apparatus that prevents a car door being opened between floors.

BACKGROUND ART

In conventional elevators, a car door locking apparatus that locks a car door is disposed on a car to prevent passengers inside the car from forcing the car doors open and falling into a hoistway if the car has stopped between floors. The car door locking apparatus has a latch that is operated by an electromagnetic coil, and unlocks only when the car is at a landing floor (see Patent Literature 1, for example).

In other conventional elevators, unlocking cams are installed on a landing side, and a car door locking apparatus that unlocks mechanically only when the car arrives at positions that have unlocking cams is disposed on a car (see Patent Literature 2, for example).

In addition, car door locking apparatuses have also been proposed that are configured such that engaging parts (blades) on a landing side unlock only when an engaging part (a roller) on a car comes into contact therewith (see Patent Literature 3, for example).

CITATION LIST

Patent Literature

[Patent Literature 1]
Japanese Patent Laid-Open No. HEI 8-59153 (Gazette)
[Patent Literature 2]
Japanese Patent Publication No. 2008-528399 (Gazette)
[Patent Literature 3]
Japanese Patent Publication No. SHO 59-30638 (Gazette)

SUMMARY OF THE INVENTION

Problem to be Solved by the Invention

In the car door locking apparatus that is disclosed in Patent Literature 1, because the latch is operated by an electromagnetic coil, if there is an electrical outage, there is a risk that it may not be possible to open the door from inside the car even if the car arrives at the proper position, prolonging the state of confinement, and giving rise to a need to carry a battery in preparation.

In the car door locking apparatus that is disclosed in Patent Literature 2, it is necessary to install unlocking cams on all of the floors, in addition to landing door engaging members, requiring a lot of steel plate if there is a large number of floors, and also increasing installation costs.

In addition, in the car door locking apparatus that is disclosed in Patent Literature 3, it is necessary to increase the holding force of a spring for holding a locked state so as to prevent malfunctions due to mechanical shock (abnormal unlocking operations) from occurring, thereby also making the unlocking operation heavy.

On the other hand, because the unlocking operation is performed when the engaging parts on the car side come into contact with the engaging parts on the landing side, they are required to operate using less force than the force necessary to open the landing doors, making adjustment of the holding force difficult.

The present invention aims to solve the above problems and an object of the present invention is to provide an elevator car door locking apparatus that can make forced opening due to tampering and malfunction due to mechanical shock less likely to occur using a simple configuration.

Means for Solving the Problem

In order to achieve the above object, according to one aspect of the present invention, there is provided an elevator car door locking apparatus including: a locking apparatus that locks a car door in a closed position; a linking mechanism that includes links that are disposed on the car door so as to be pivotable around pivoting shafts; a doorstop-side blade that is disposed on the car door by means of the linking mechanism, and that is displaceable horizontally between a locked position, and an unlocked position that is further away from a door pocket than the locked position; a transmission mechanism that mechanically transmits displacement of the doorstop-side blade toward the unlocked position to the locking apparatus to place the locking apparatus in an unlocked state; and a balance weight that is disposed on an opposite side of the pivoting shaft of the link from the doorstop-side blade, wherein the elevator car door locking apparatus is configured such that the doorstop-side blade comes into contact with a landing door engaging member that is disposed on a landing door and displaces to the unlocked position, and the balance weight also displaces away from the doorstop-side blade, due to the car door moving toward the door pocket side when a car is in position at a floor.

Effects of the Invention

In an elevator car door locking apparatus according to the present invention, because the force of inertia that acts on the doorstop-side blade in the opening operation of the car door is suppressed by the reverse action of the balance weight, the acting force on the locking apparatus through the linking mechanism can be reduced, enabling malfunctions due to forced opening due to tampering and mechanical shock to be made less likely to occur.

DESCRIPTION OF EMBODIMENTS

Preferred embodiments of the present invention will now be explained with reference to the drawings.

Embodiment 1

Figure 1:
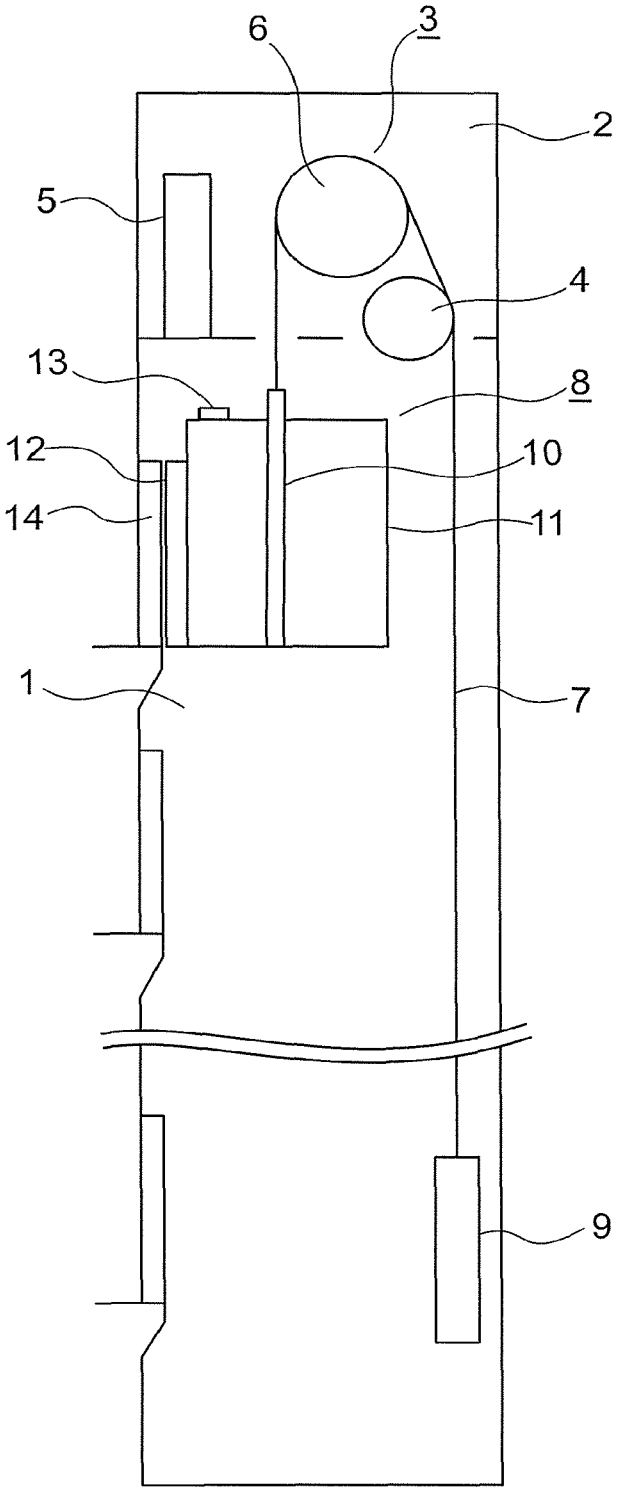
FIG. 1 is a schematic configuration diagram that shows an elevator according to Embodiment 1 of the present invention.

FIG. 1 is a schematic configuration diagram that shows an elevator according to Embodiment 1 of the present invention. In the figure, a machine room 2 is disposed in an upper portion of a hoistway 1. A hoisting machine (a driving apparatus) 3, a deflecting sheave 4, and an elevator controlling apparatus (a controlling board) 5 are installed in the machine room 2. The hoisting machine 3 has: a driving sheave 6; a hoisting machine motor (not shown) that rotates the driving sheave 6; and a hoisting machine brake (not shown) that brakes rotation of the driving sheave 6.

A suspending body 7 is wound onto the driving sheave 6 and the deflecting sheave 4. A plurality of ropes or a plurality of belts are used as the suspending body 7. A car 8 is connected to a first end portion of the suspending body 7. A counterweight 9 is connected to a second end portion of the suspending body 7.

The car 8 and the counterweight 9 are suspended inside the hoistway 1 by the suspending body 7 so as to be raised and lowered inside the hoistway 1 by the hoisting machine 3. The elevator controlling apparatus 5 controls operation of the car 8 by controlling the hoisting machine 3.

A pair of car guide rails (not shown) that guide raising and lowering of the car 8 and a pair of counterweight guide rails (not shown) that guide raising and lowering of the counterweight 9 are installed inside the hoistway 1.

The car 8 has: a car frame 10 to which the suspending body 7 is connected; and a cage 11 that is supported by the car frame 10. A pair of car doors 12 that open and close a car doorway are disposed on a front surface of the cage 11. A door controller 13 that controls opening and closing operations of the car doors 12 is disposed on the car 8.

Pairs of landing doors 14 that open and close landing doorways are respectively disposed on landings of a plurality of floors. The landing doors 14 are operated so as to perform opening and closing operations interdependently with the car doors 12 by engaging with the car doors 12 when the car 8 is at a floor.

Figure 2:
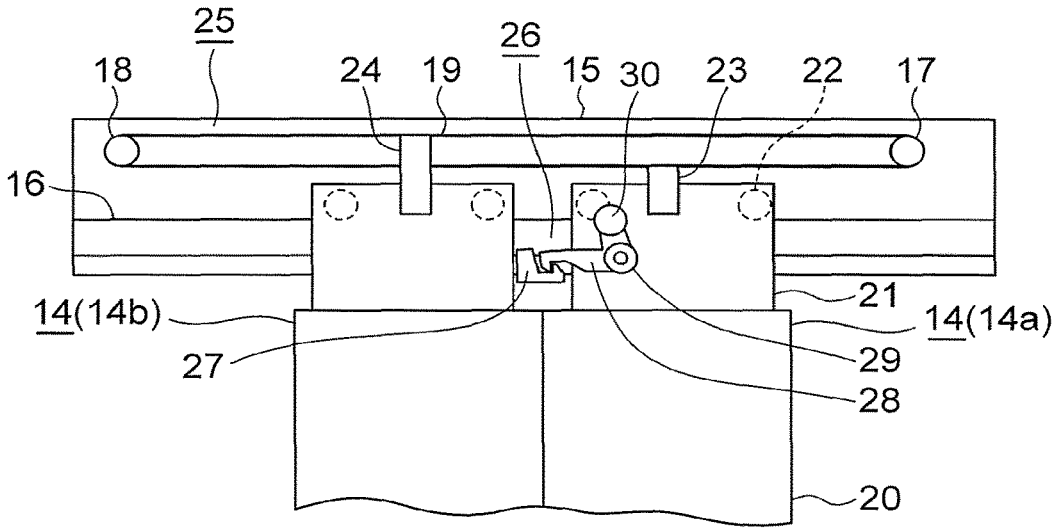
FIG. 2 is a front elevation of landing doors from FIG. 1 when viewed from a hoistway side.

FIG. 2 is a front elevation of landing doors 14 from FIG. 1 when viewed from a hoistway side. A landing door frame 15 is fixed to an upper portion of the landing doorway. A landing door rail 16 that is parallel to a width direction of the landing doorway is disposed on the landing door frame 15.

A first landing door pulley 17 is disposed on a first longitudinal end portion of the landing door frame 15. A second landing door pulley 18 is disposed on a second longitudinal end portion of the landing door frame 15. An endless coupling rope 19 is wound onto the first and second landing door pulleys 17 and 18.

Each of the landing doors 14 has: a landing door panel 20; and a landing door hanger 21 that is fixed to an upper portion of the landing door panel 20. A plurality of landing door rollers 22 that are rolled along the landing door rail 16 are disposed on each of the landing door hangers 21. Each of the landing doors 14 is suspended by the landing door rail 16, and performs the opening and closing operations parallel to the landing door rail 16.

A first landing door 14*a*, which is one of the landing doors 14, is connected to the coupling rope 19 by means of a first landing door linking fitting 23. A second landing door 14*b*, which is the other of the landing doors 14, is connected to the coupling rope 19 by means of a second landing door linking fitting 24.

When the coupling rope 19 is cycled by the opening and closing operations of the first landing door 14*a*, the second landing door 14*b* is moved in an opposite direction to the first landing door 14*a*. The landing door interlocking mechanism 25 includes the landing door pulleys 17 and 18, the coupling rope 19, and the landing door linking fittings 23 and 24, and interlocks the second landing door 14*b* to the opening and closing operations of the first landing door 14*a*.

An interlocking apparatus 26 for preventing the landing doors 14 from being opened from the landing when the car 8 is not at that floor is disposed between the first landing door 14*a* and the landing door frame 15. The interlocking apparatus 26 has: a catch 27; an interlocking latch 28; a fixed interlocking roller 29; and a movable interlocking roller 30.

The catch 27 is fixed to the landing door frame 15. The interlocking latch 28 is mounted pivotably to the landing door hanger 21 of the first landing door 14*a*. When the landing doors 14 are in a fully closed state, movement of the landing doors 14 in the opening direction is prevented by a tip end portion of the interlocking latch 28 engaging with the catch 27.

The fixed interlocking roller 29 is disposed so as to be coaxial with the pivoting shaft of the interlocking clutch 28. The movable interlocking roller 30 is mounted to the interlocking latch 28, and is pivotable together with the interlocking latch 28.

Figure 3:
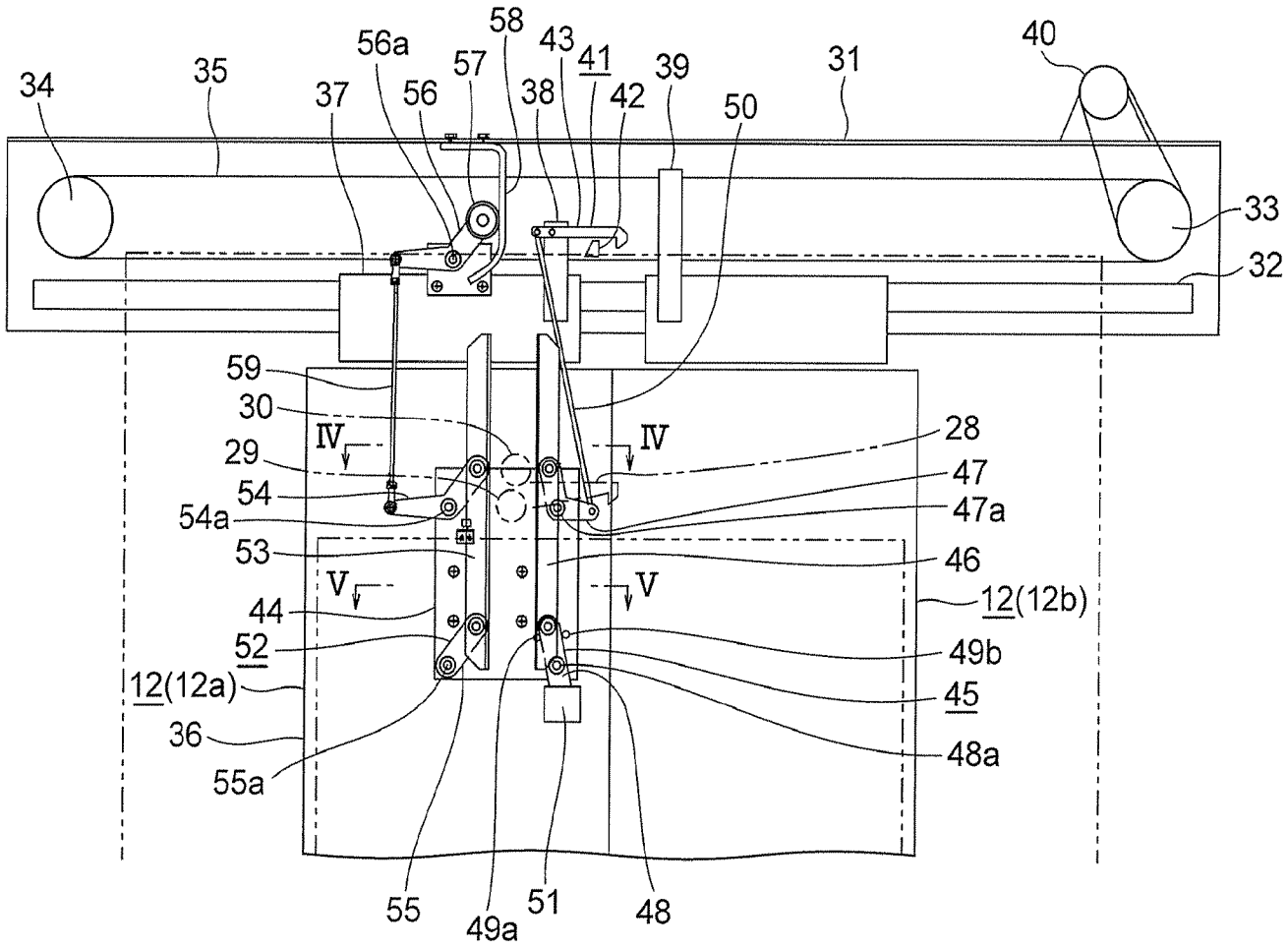
FIG. 3 is a front elevation of car doors from FIG. 1 when viewed from a landing side.

FIG. 3 is a front elevation of car doors 12 from FIG. 1 when viewed from a landing side. A car door frame 31 is fixed to an upper portion of the car doorway. A car door rail 32 that is parallel to a width direction of the car doorway is disposed on the car door frame 31.

A driving pulley 33 is disposed on a first longitudinal end portion of the car door frame 31. A driven pulley 34 is disposed on a second longitudinal end portion of the car door frame 31. An endless car door driving rope 35 is wound onto the driving pulley 33 and the driven pulley 34.

Each of the car doors 12 has: a car door panel 36; and a car door hanger 37 that is fixed to an upper portion of the car door panel 36. Each of the car doors 12 is suspended by the car door rail 32, and performs the opening and closing operations parallel to the car door rail 32.

A first car door 12*a*, which is one of the car doors 12, is connected to the car door driving rope 35 by means of a first car door linking fitting 38. A second car door 12*b*, which is the other of the car doors 12, is connected to the car door driving rope 35 by means of a second car door linking fitting 39.

A door motor 40 is fixed above the car door frame 31. Rotation of the door motor 40 is transmitted to the driving pulley 33. When the driving pulley 33 is rotated by the door motor 40, the car door driving rope 35 is cycled and the driven pulley 34 is rotated. The first and second car doors 12*a* and 12*b* perform the opening and closing operations thereby.

A locking apparatus 41 that locks the first car door 12*a* in a closed position is disposed between the car door frame 31 and the first car door 12*a*. The locking apparatus 41 has: a fixed latch 42 that is fixed to the car door frame 31; and a movable latch 43 that is pivotably disposed on the first car door 12*a*. If an attempt is made to open the car doors 12 without unlocking the locking apparatus 41, the movable latch 43 comes into contact with the fixed latch 42, preventing movement of the car doors 12 in the opening direction.

A supporting plate 44 is fixed to the first car door 12*a*. A doorstop-side blade 46 that has an L-shaped cross section is mounted to the supporting plate 44 by means of a first parallel linking mechanism 45. The first parallel linking mechanism 45 has a first upper portion link 47 and a first lower portion link 48.

The first upper portion link 47 is mounted to the supporting plate 44 so as to be pivotable around a pivoting shaft 47*a*. The first lower portion link 48 is mounted to the supporting plate 44 so as to be pivotable around a pivoting shaft 48*a*.

The doorstop-side blade 46 is linked pivotably to first end portions of the links 47 and 48. The doorstop-side blade 46 is disposed vertically. In addition, the doorstop-side blade 46 is displaceable in a horizontal direction (the opening and closing direction of the car doors 12) by the pivoting of the links 47 and 48 between a locked position (FIG. 3), and an unlocked position (FIG. 6) that is further away from the door pocket (nearer to a doorstop) than the locked position.

A pair of stoppers 49*a* and 49*b* that limit a range of available movement of the doorstop-side blade 46 are disposed on the supporting plate 44. The doorstop-side blade 46 is constantly forced to a door pocket side of the range of available movement, i.e., toward the locked position by the action of gravity or a spring force.

A first linking rod 50 is disposed between the first upper portion link 47 and the locking apparatus 41. A lower end portion of the first linking rod 50 is linked pivotably to a second end portion (an end portion on an opposite side of the pivoting shaft 47*a* from the doorstop-side blade 46) of the first upper portion link 47. An upper end portion of the first linking rod 50 is linked pivotably to the fixed latch 42.

Figure 6:
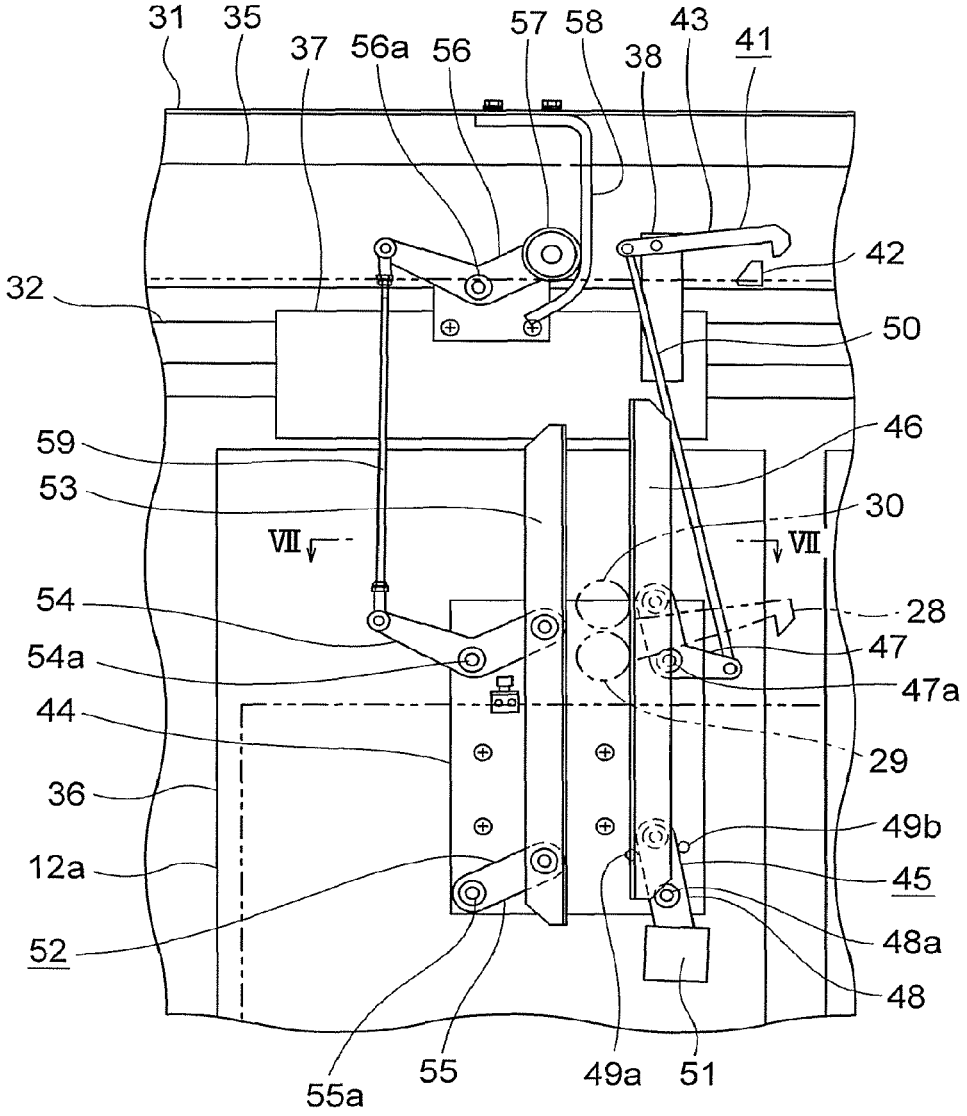
FIG. 6 is a front elevation that shows a state in which the car doors in FIG. 3 have moved slightly in an opening direction.

The first linking rod 50 thereby transmits displacement of the doorstop-side blade 46 toward the unlocked position to the locking apparatus 41 mechanically to place the locking apparatus 41 in the unlocked state. In other words, when the doorstop-side blade 46 is in the locked position, the movable latch 43 is in the locked state (FIG. 3), and when the doorstop-side blade 46 is in the unlocked position, the movable latch 43 is in the unlocked state (FIG. 6). The transmission mechanism according to Embodiment 1 is constituted by the first linking rod 50.

A balance weight 51 is disposed on a second end portion (an end portion at an opposite side of the pivoting shaft 48*a* from the doorstop-side blade 46) of the first lower portion link 48.

The doorstop-side blade 46 comes into contact with the interlocking rollers 29 and 30, which constitute landing door engaging members, and displaces toward the unlocked position, and the balance weight 51 also displaces away from the doorstop-side blade 46, due to the first car door 12*a* moving toward the door pocket (to the left in FIG. 3) when the car 8 is in position at a floor.

A door pocket-side blade 53 that has an L-shaped cross section is mounted to the supporting plate 44 by means of a second parallel linking mechanism 52. The second parallel linking mechanism 52 has a second upper portion link 54 and a second lower portion link 55.

The second upper portion link 54 is mounted to the supporting plate 44 so as to be pivotable around a pivoting shaft 54*a*. The second lower portion link 55 is mounted to the supporting plate 44 so as to be pivotable around a pivoting shaft 55*a*.

The door pocket-side blade 53 is linked pivotably to first end portions of the links 54 and 55. The door pocket-side blade 53 is disposed parallel to the doorstop-side blade 46, i.e., vertically. In addition, the door pocket-side blade 53 is displaceable in a horizontal direction (the opening and closing direction of the car doors 12) by the pivoting of the links 54 and 55.

A pivoting member 56 that is pivotable around a pivoting shaft 56*a* is disposed on an upper portion of the first car door 12*a*. A pivoting member roller 57 is disposed on a first end portion of the pivoting member 56. A guiding member 58 that the pivoting member roller 57 contacts when the first car door 12*a* is in the closed position is fixed to the car door frame 31.

A second linking rod 59 is linked between a second end portion of the pivoting member 56 and a second end portion of the second upper portion link 54. The door pocket-side blade 53 is forced to a doorstop side by the action of gravity or a spring force.

When the first car door 12*a* is in the closed position, the pivoting member roller 57 is in contact with the guiding member 58, and the door pocket-side blade 53 is separated from the interlocking rollers 29 and 30.

In contrast to that, when the first car door 12*a* is moved in the opening direction, the pivoting member 56 is pivoted clockwise in FIG. 3, and the door pocket-side blade 53 also displaces toward the doorstop-side blade 46, reducing spacing between the blades 46 and 53, and the interlocking rollers 29 and 30 are gripped between the blades 46 and 53.

Moreover, a configuration that makes the door pocket-side blade 53 displaceable horizontally is not required, and the door pocket-side blade 53 may alternatively be fixed to the car doors 12.

Figure 4:
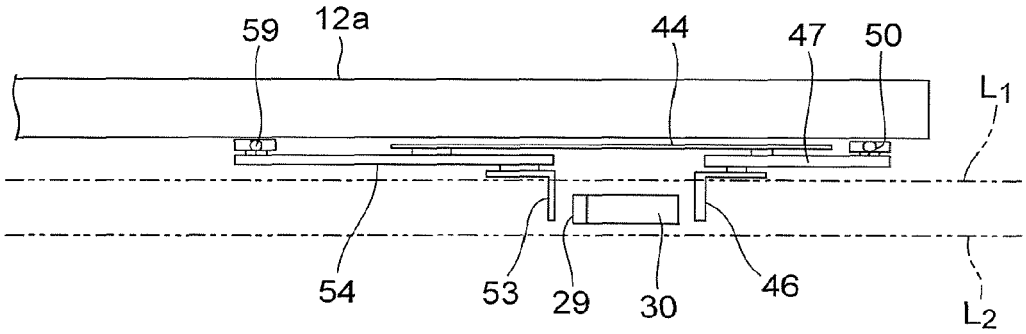
FIG. 4 is a cross section that is taken along Line IV-IV in FIG. 3.
Figure 5:
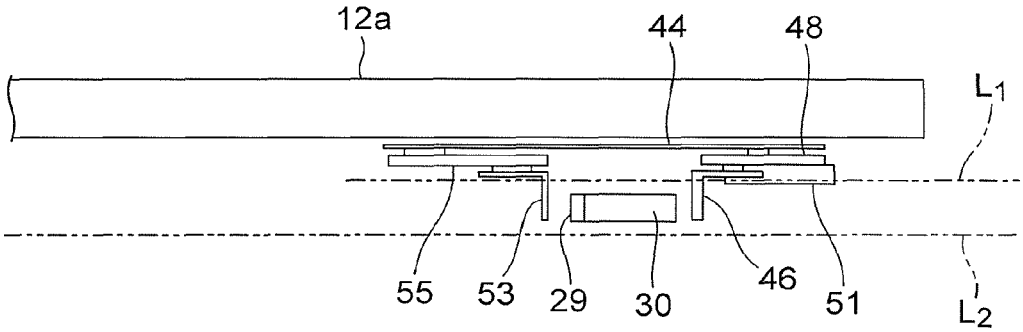
FIG. 5 is a cross section that is taken along Line V-V in FIG. 3.

FIG. 4 is a cross section that is taken along Line IV-IV in FIG. 3, and FIG. 5 is a cross section that is taken along Line V-V in FIG. 3. When the car 8 is at a floor, the doorstop-side blade 46 is disposed toward the doorstop side of the interlocking rollers 29 and 30, and the door pocket-side blade 53 is disposed toward the door pocket side of the interlocking rollers 29 and 30.

The interlocking rollers 29 and 30 are disposed between a car doorsill line (a landing-side end surface of the car doorsill) $L_1$ and a landing doorsill line (a car-side end surface of the landing doorsill) $L_2$ when viewed from directly above. In addition, the links 47, 48, 54, and 55, the linking portions between the links 47 and 48 of the doorstop-side blade 46, and the linking portions between the links 54 and 55 of the door pocket-side blade 53 are disposed inside (on the car 8 side of) the car doorsill line $L_1$ when viewed from directly above.

Next, operation will be explained. As shown in FIGS. 4 and 5, when the car doors 12 are in a fully closed position, the doorstop-side blade 46 is positioned at the locked position, and is separated from the interlocking rollers 29 and 30. The movable latch 43 is also in the locked state.

Figure 7:
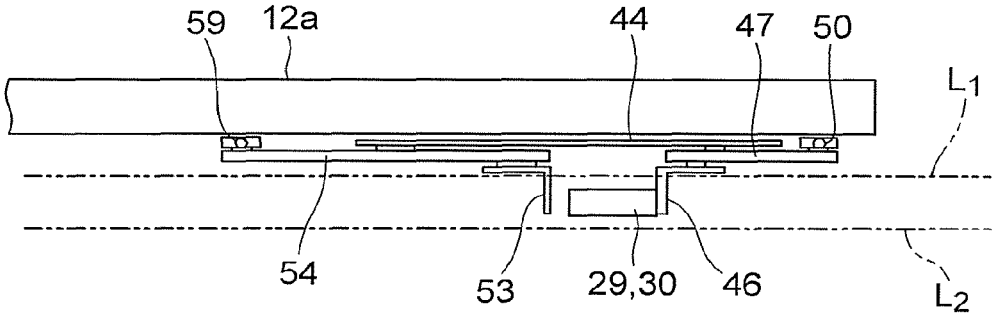
FIG. 7 is a cross section that is taken along Line VII-VII in FIG. 6.

FIG. 6 is a front elevation that shows a state in which the car doors 12 in FIG. 3 have moved slightly in an opening direction, and FIG. 7 is a cross section that is taken along Line VII-VII in FIG. 6. When the car doors 12 begin to move in the opening direction, a contacting surface of the doorstop-side blade 46 (a surface that is perpendicular to the front surface of the first car door 12*a*) comes into contact with the interlocking rollers 29 and 30, such that the doorstop-side blade 46 is displaced to the unlocked position. Thus, the movable latch 43 is placed in the unlocked state. The interlocking latch 28 is pivoted, also placing the interlocking apparatus 26 of the landing doors 14 in the unlocked state.

Figure 8:
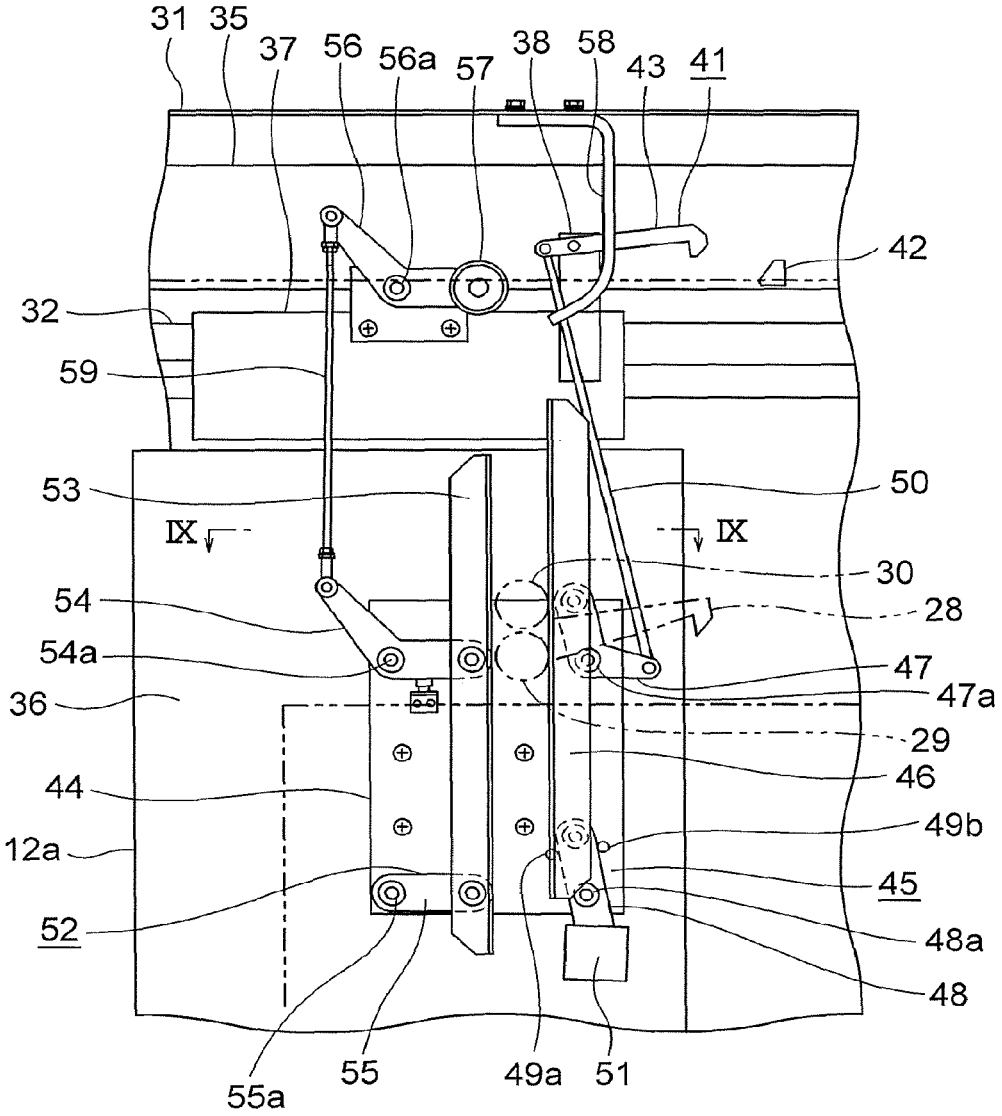
FIG. 8 is a front elevation that shows a state in which the car doors in FIG. 6 have moved further in the opening direction.
Figure 9:
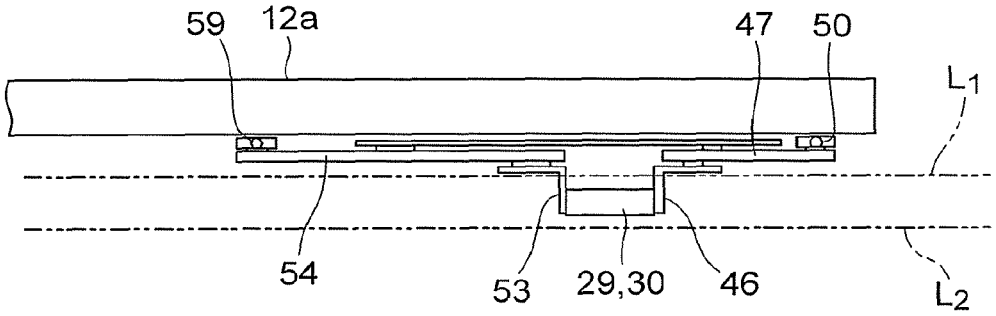
FIG. 9 is a cross section that is taken along Line IX-IX in FIG. 8.

FIG. 8 is a front elevation that shows a state in which the car doors 12 in FIG. 6 have moved further in the opening direction, and FIG. 9 is a cross section that is taken along Line IX-IX in FIG. 8. When the car doors 12 move further in the opening direction, the door pocket-side blade 53 moves toward a doorstop side relative to the first car door 12*a*, such that the interlocking rollers 29 and 30 are gripped between the blades 46 and 53, and the first car door 12*a* and the first landing door 14*a* perform the opening operation together. The second car door 12*b* and the second landing door 14*b* also perform the opening operation in synchrony.

Figure 10:
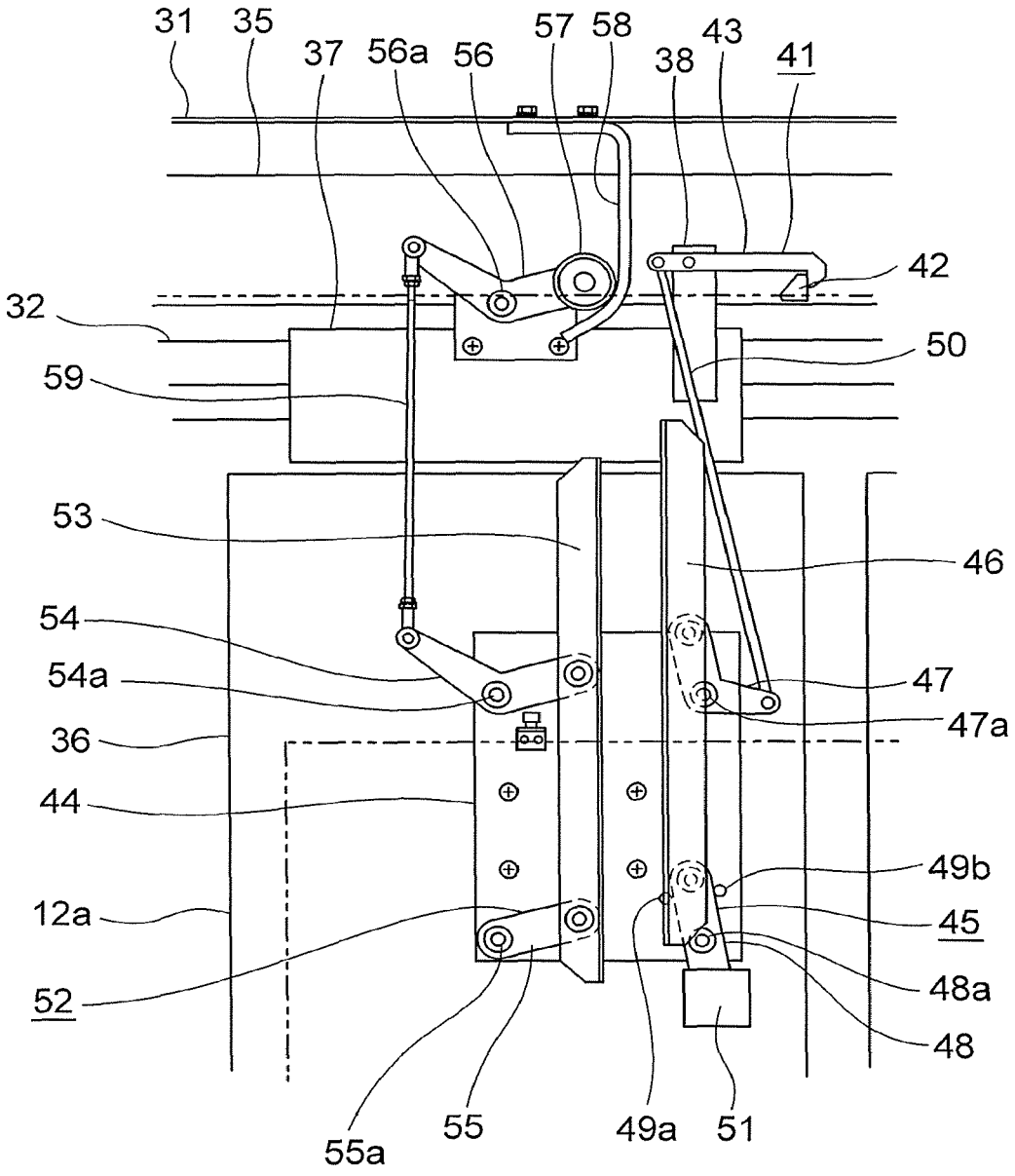
FIG. 10 is a front elevation that shows a state in which an attempt has been made to open the car doors in FIG. 3 outside a door zone.

If, on the other hand, the car 8 is in a stopped state outside the door zone due to some abnormality, and a passenger inside the cage 11 attempts to force the car doors 12 open, then because the interlocking rollers 29 and 30 do not contact the doorstop-side blade 46, as shown in FIG. 10, the doorstop-side blade 46 remains positioned in the locked position, and the movable latch 43 also remains in the locked state. Because of that, the movable latch 43 comes into contact with the fixed latch 42 when the first car door 12*a* has moved slightly toward the door pocket, preventing movement of the car doors 12 in the opening direction.

In a car door locking apparatus of this kind, because the force of inertia that acts on the doorstop-side blade 46 in the opening operation of the car doors 12 is suppressed by the reverse action of the balance weight 51, the acting force on the locking apparatus 41 through the first parallel linking mechanism 45 can be reduced, enabling forced opening due to tampering and malfunctions (unlocking operations that are not normal) due to mechanical shock to be made less likely to occur.

Here, it is preferable for the weight of the balance weight 51 to be set such that the moment around the pivoting shafts due to the force of inertia of the first parallel linking mechanism 45 and the balance weight 51 when the car doors 12 perform the opening and closing operations and the moment around the pivoting shafts 47*a* and 48*a* due to the force of inertia of the doorstop-side blade 46 that is applied to the connecting position of the doorstop-side blade 46 onto the first parallel linking mechanism 45 when the car doors 12 perform the opening and closing operations balance with each other (including a state in which they are approximately balanced).

The moment around the pivoting shafts 47*a* and 48*a* due to force of inertia can thereby be reduced positively during the opening and closing operations of the car doors, enabling forced opening due to tampering and malfunctions due to mechanical shock to be more reliably made less likely to occur.

Embodiment 2

Figure 11:
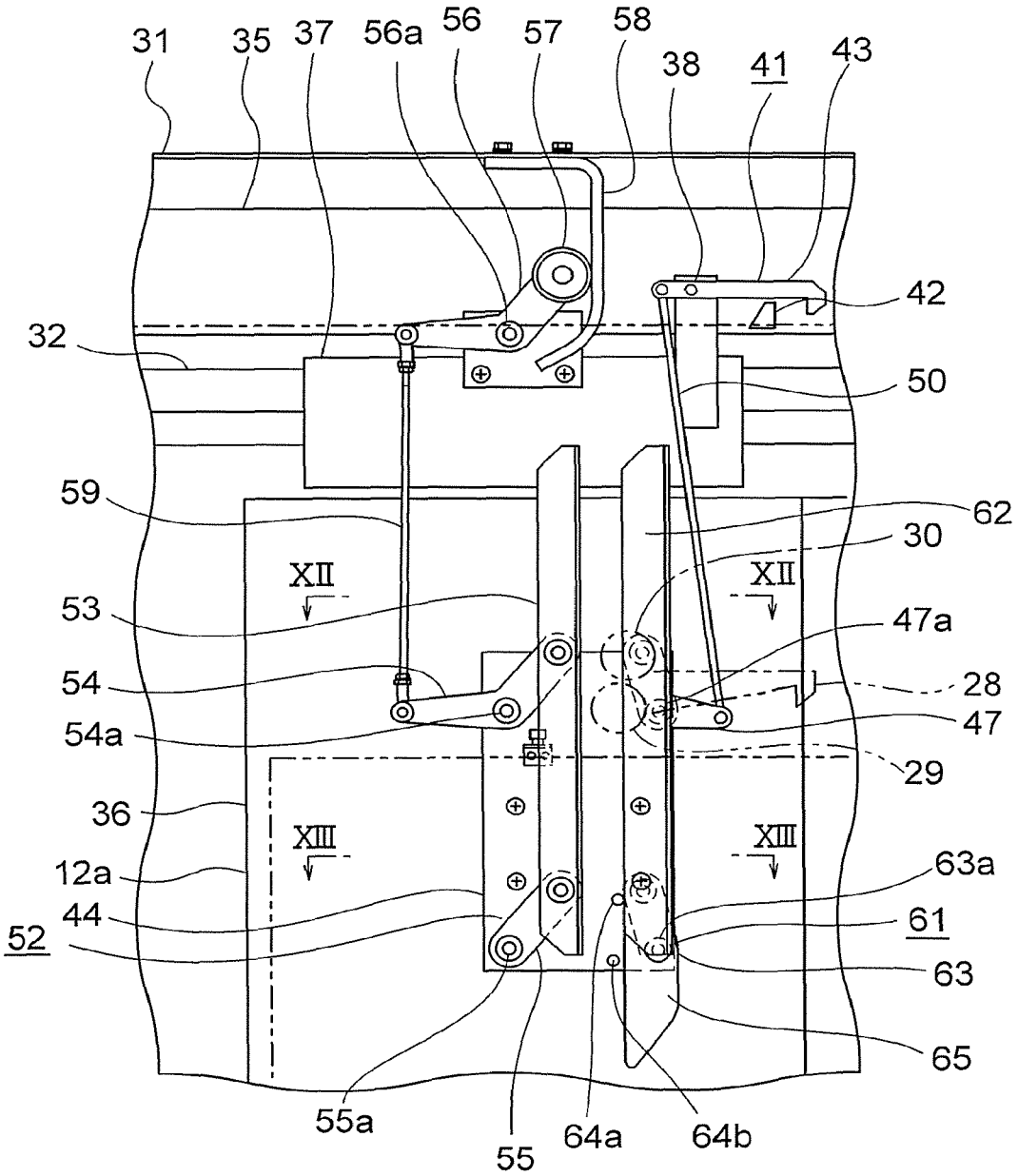
FIG. 11 is a front elevation that shows an elevator car door locking apparatus according to Embodiment 2 of the present invention.
Figure 12:
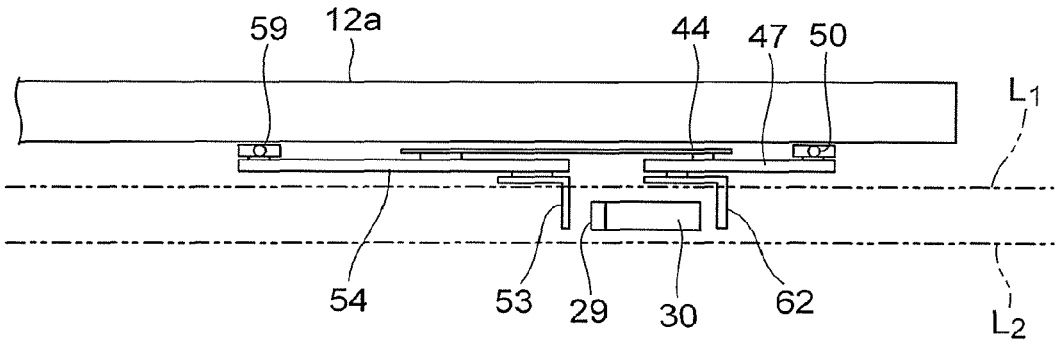
FIG. 12 is a cross section that is taken along Line XII-XII in FIG. 11.
Figure 13:
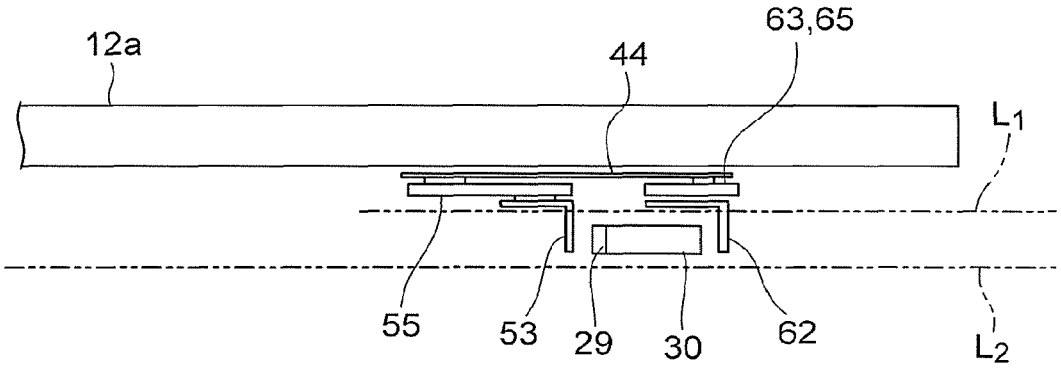
FIG. 13 is a cross section that is taken along Line XIII-XIII in FIG. 11.

Next, FIG. 11 is a front elevation that shows an elevator car door locking apparatus according to Embodiment 2 of the present invention, FIG. 12 is a cross section that is taken along Line XII-XII in FIG. 11, and FIG. 13 is a cross section that is taken along Line XIII-XIII in FIG. 11. A doorstop-side blade 62 that has an L-shaped cross section is mounted to a supporting plate 44 by means of a first parallel linking mechanism 61. The first parallel linking mechanism 61 has: a first upper portion link 47 that is similar or identical to that of Embodiment 1; and a first lower portion link 63 that is different than that of Embodiment 1.

The first lower portion link 63 is mounted to the supporting plate 44 so as to be pivotable around a pivoting shaft 63*a*.

The doorstop-side blade 62 is linked pivotably to first end portions of the links 47 and 63. The doorstop-side blade 62 is disposed vertically. In addition, the doorstop-side blade 62 is displaceable in a horizontal direction (the opening and closing direction of the car doors 12) by the pivoting of the links 47 and 63 between a locked position (FIG. 3), and an unlocked position that is further away from the door pocket than the locked position.

A pair of stoppers 64*a* and 64*b* that limit a range of available movement of the doorstop-side blade 62 are disposed on the supporting plate 44. The doorstop-side blade 62 is constantly forced to a door pocket side of the range of available movement, i.e., toward the locked position by the action of gravity or a spring force.

In Embodiment 1, the contacting surface of the doorstop-side blade 46 with the interlocking rollers 29 and 30 (a surface that is perpendicular to the front surface of the first car door 12*a*) is disposed on a door pocket-side end portion of the doorstop-side blade 46, but in Embodiment 2, a contacting surface of the doorstop-side blade 62 with interlocking rollers 29 and 30 is disposed on an end portion of the doorstop-side blade 62 on a doorstop side.

A balance weight 65 according to Embodiment 2 is disposed integrally on a second end portion (an end portion on an opposite side of the pivoting shaft 48*a* from the doorstop-side blade 46) of the first lower portion link 63. Specifically, the balance weight 65 is a portion of the first lower portion link 63 that is extended away from the doorstop-side blade 62. Furthermore, a mass and length of the balance weight 65 are designed appropriately so as to enable the force of inertia of the doorstop-side blade 62 to be canceled during the opening and closing operations of the first car door 12*a*, in a similar manner to Embodiment 1.

The pivoting shafts 47*a* and 63*a* and the balance weight 65 are disposed closer to a door pocket side than the contacting surface of the doorstop-side blade 62 with the interlocking rollers 29 and 30 when viewed from directly above. Portions of the doorstop-side blade 62 other than the contacting surface are disposed inside (on the car 8 side of) a car doorsill line $L_1$ when viewed from directly above.

In other words, the links 47 and 63 are rotatably linked to the doorstop-side blade 62 inside the car doorsill line $L_1$, and closer to the door pocket side than the contacting surface of the doorstop-side blade 62, when viewed from directly above. The rest of the configuration is similar or identical to that of Embodiment 1.

In a car door locking apparatus of this kind, because the force of inertia that acts on the doorstop-side blade 62 in the opening operation of the car doors 12 is suppressed by the reverse action of the balance weight 51, the acting force on the locking apparatus 41 through the first parallel linking mechanism 61 can be reduced, enabling forced opening due to tampering and malfunctions (unlocking operations that are not normal) due to mechanical shock to be made less likely to occur.

Another effect is that the balance weight 65 can be disposed in allowable space without interference in an elevator door apparatus of standard construction, and it is not necessary to remodel an elevator door apparatus of standard construction significantly.

Embodiment 3

Figure 14:
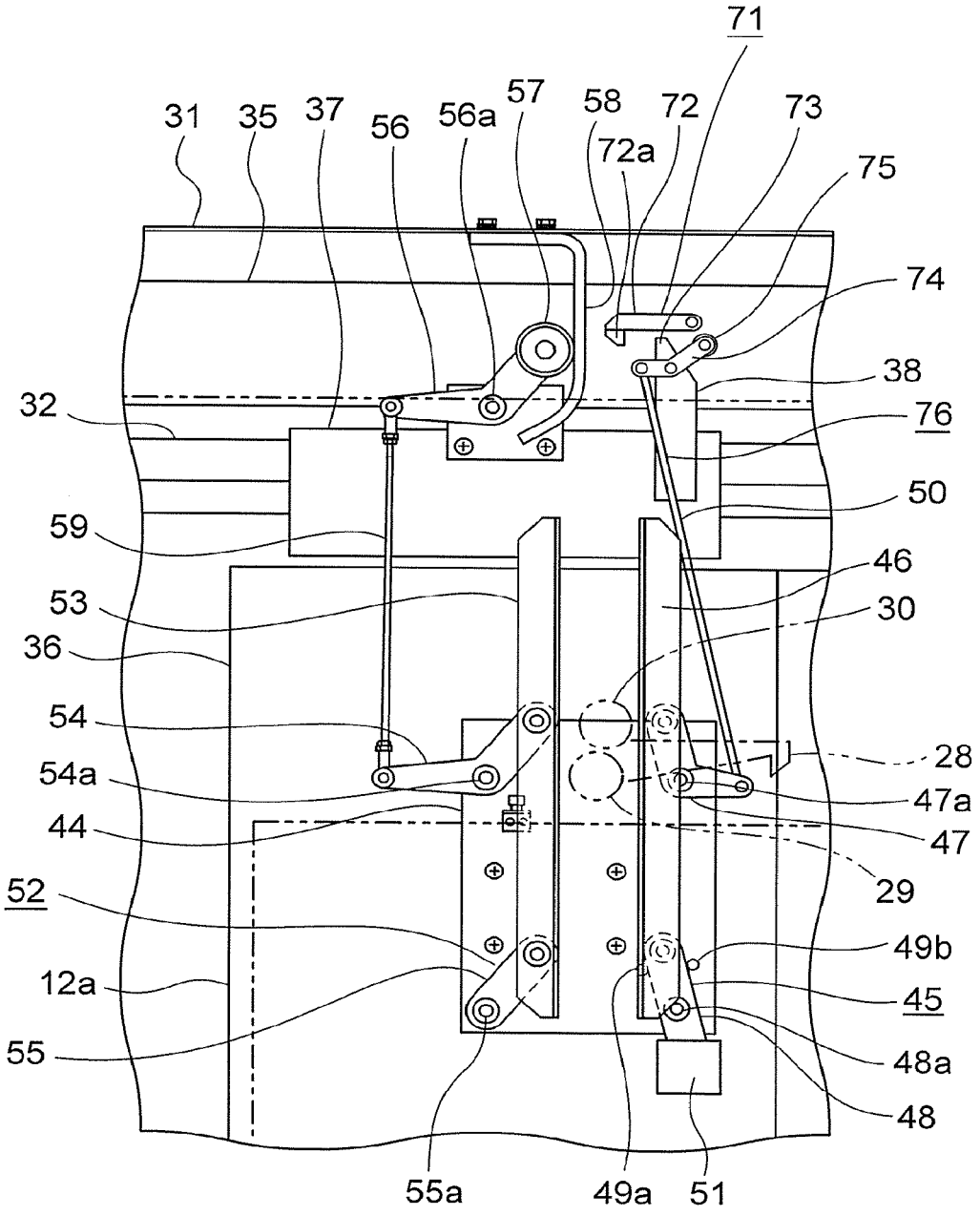
FIG. 14 is a front elevation that shows an elevator car door locking apparatus according to Embodiment 3 of the present invention.

Next, FIG. 14 is a front elevation that shows an elevator car door locking apparatus according to Embodiment 3 of the present invention. A locking apparatus 71 that locks a first car door 12*a* in a closed position is disposed between a car door frame 31 and the first car door 12*a*. The locking apparatus 71 has: a car-side latch 72 that is pivotably disposed on the car door frame 31; and a door-side latch 73 that is disposed on a first car door linking fitting 38.

The door-side latch 73 is formed integrally on the first car door linking fitting 38 by extending an upper end portion of the first car door linking fitting 38 upward. If an attempt is made to open the car doors 12 without unlocking the locking apparatus 71, the door-side latch 73 comes into contact with the car-side latch 72, preventing movement of the car doors 12 in the opening direction.

An unlocking lever 74 is disposed pivotably on the first car door linking fitting 38. An upper end portion of a first linking rod 50 is linked pivotably to a first end portion of the unlocking lever 74. An unlocking roller 75 is disposed on a second end portion of the unlocking lever 74. A transmission mechanism 76 according to Embodiment 3 includes the first linking rod 50, the unlocking lever 74, and the unlocking roller 75. The rest of the configuration is similar or identical to that of Embodiment 1.

Next, operation will be explained. As shown in FIG. 14, when the car doors 12 are in a fully closed position, the doorstop-side blade 46 is positioned at the locked position, and the car-side latch 72 is in a locked state (a horizontal state).

Figure 15:
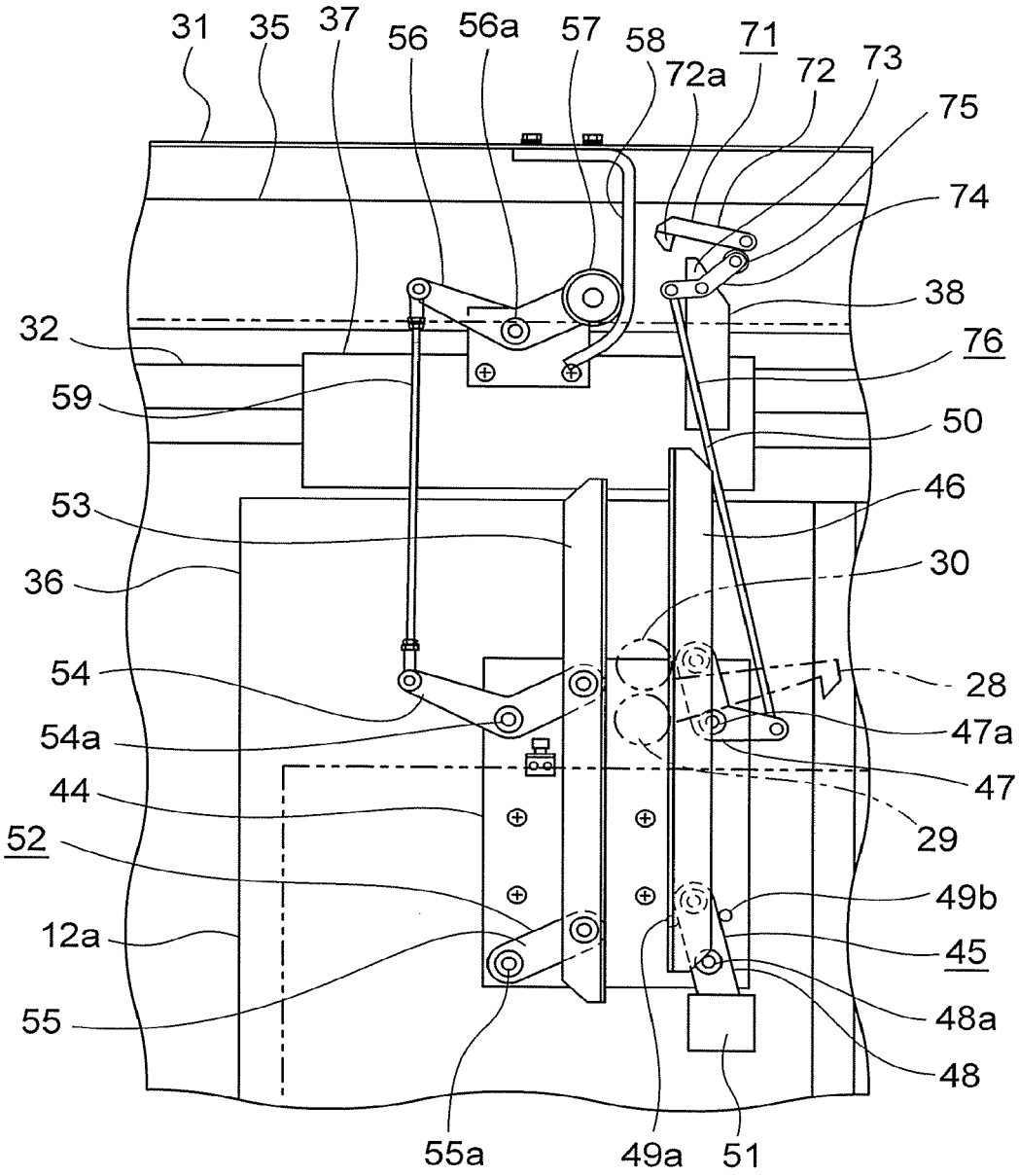
FIG. 15 is a front elevation that shows a state in which the car doors in FIG. 14 have moved slightly in an opening direction.
Figure 16:
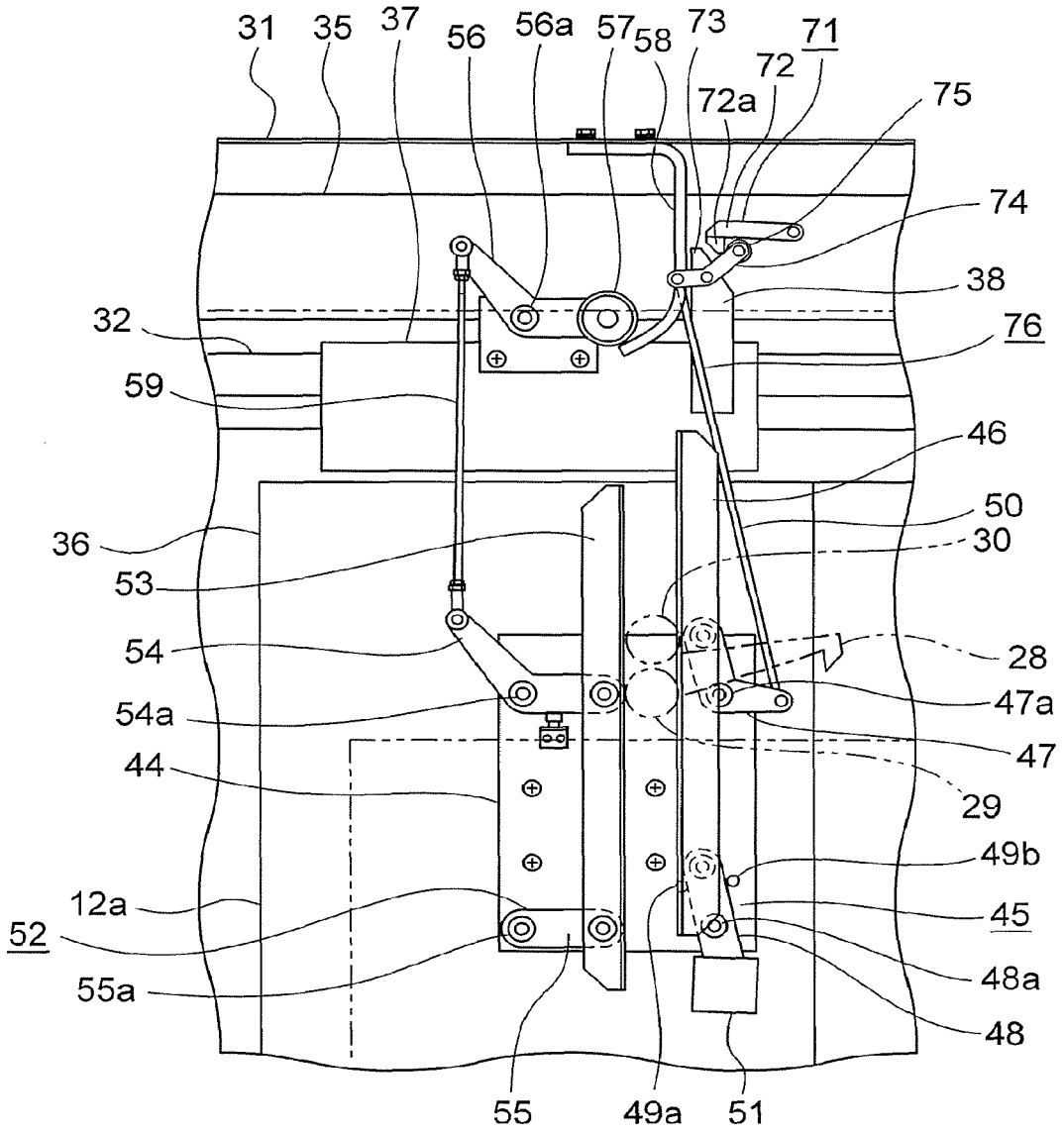
FIG. 16 is a front elevation that shows a state in which the car doors in FIG. 15 have moved further in the opening direction.

FIG. 15 is a front elevation that shows a state in which the car doors 12 in FIG. 14 have moved slightly in an opening direction, and FIG. 16 is a front elevation that shows a state in which the car doors 12 in FIG. 15 have moved further in the opening direction. When the car doors 12 begin to move in the opening direction, the doorstop-side blade 46 comes into contact with the interlocking rollers 29 and 30, such that the doorstop-side blade 46 is displaced to the unlocked position.

The unlocking lever 74 is thereby pivoted counterclockwise in the figure, and the car-side latch 72 is pivoted by the unlocking roller 75 clockwise in the figure to be placed in the unlocked state. As shown in FIG. 16, the door-side latch 73 passes an engaging portion 72*a* on a tip end of the car-side latch 72. When the unlocking roller 75 is not in contact, the car-side latch 72 is returned to the horizontal state by the action of gravity or a spring force. Furthermore, inclined surfaces are disposed on both the engaging portion 72*a* of the car-side latch 73 and the door-side latch 73, enabling the car-side latch 72 to be pivoted by the inclined surface and be placed in the unlocked state during the closing operation of the car doors 12.

Figure 17:
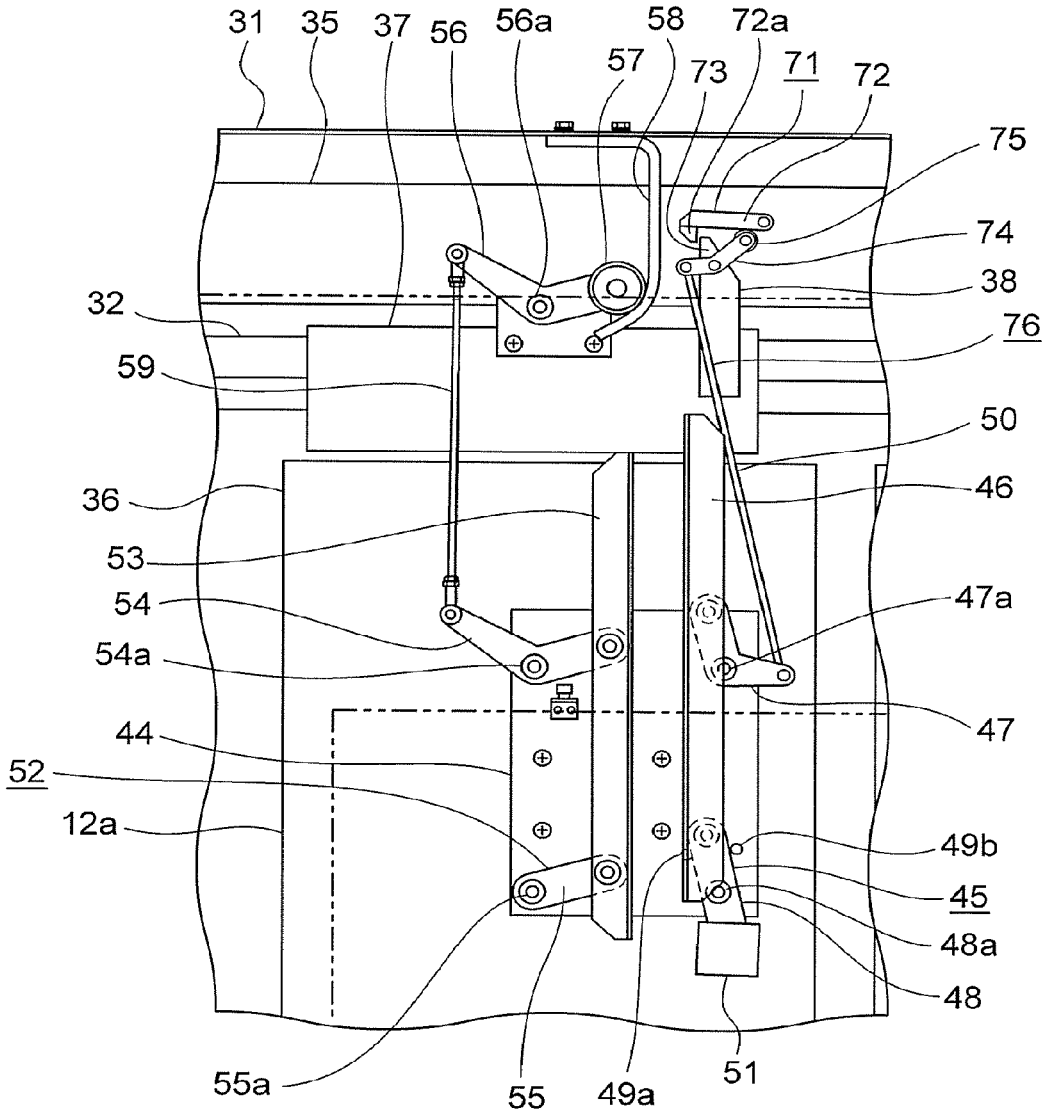
FIG. 17 is a front elevation that shows a state in which an attempt has been made to open the car doors in FIG. 14 outside a door zone.

If, on the other hand, the car 8 is in a stopped state outside the door zone due to some abnormality, and a passenger inside the cage 11 attempts to force the car doors 12 open, then because the interlocking rollers 29 and 30 do not contact the doorstop-side blade 46, as shown in FIG. 17, the doorstop-side blade 46 remains positioned in the locked position, and the car-side latch 72 also remains in the locked state. Because of that, the door-side latch 73 comes into contact with the car-side latch 72 when the first car door 12*a* has moved slightly toward the door pocket, preventing movement of the car doors 12 in the opening direction.

In a car door locking apparatus of this kind, because the pivotable car-side latch 72 is disposed on the car door frame 31, if a lock checking switch (an electrical contact) is used, the switch can be disposed on the car 8 side instead of the first car door 12*a* side, facilitating cable wiring. Furthermore, because cables are not moved by opening and closing of the car doors 12, wire breakages are prevented in the cables, improving reliability.

Moreover, the locking apparatus 71 and the transmission mechanism 76 according to Embodiment 3 can also be applied to the car door locking apparatus according to Embodiment 2.

The type of elevator to which the car door locking apparatus according to the present invention is applied is not limited to the type in FIG. 1. For example, the present invention can also be applied to machine-roomless elevators, to elevators that use two-to-one (2:1) roping methods, to multi-car elevators, or to double-deck elevators.

The invention claimed is:

1. An elevator car door locking apparatus comprising:

a locking apparatus that locks a car door in a closed position;

a linking mechanism that includes links that are disposed on the car door so as to be pivotable around pivoting shafts;

a doorstop-side blade that is disposed on the car door by means of the linking mechanism, and that is displaceable horizontally between a locked position, and an unlocked position that is further away from a door pocket than the locked position;

a transmission mechanism that mechanically transmits displacement of the doorstop-side blade toward the unlocked position to the locking apparatus to place the locking apparatus in an unlocked state; and a balance weight that is disposed on an opposite side of the pivoting shaft of the link from the doorstop-side blade, wherein the elevator car door locking apparatus is configured such that the doorstop-side blade comes into contact with a landing door engaging member that is disposed on a landing door and displaces to the unlocked position, and the balance weight also displaces away from the doorstop-side blade, due to the car door moving toward the door pocket side when a car is in position at a floor.

2. The elevator car door locking apparatus according to claim 1, wherein the pivoting shaft and the balance weight are disposed closer to a door pocket side than a contacting surface of the doorstop-side blade with the landing door engaging member when viewed from directly above.

3. The elevator car door locking apparatus according to claim 1, wherein a moment around the pivoting shafts due to force of inertia of the linking mechanism and the balance weight when the car door performs opening and closing operations and a moment around the pivoting shafts due to force of inertia of the doorstop-side blade that is applied to a connecting position of the doorstop-side blade onto the linking mechanism when the car door performs the opening and closing operations balance with each other.

4. The elevator car door locking apparatus according to claim 1, wherein:

the locking apparatus includes:

a car-side latch that is disposed pivotably on the car; and a door-side latch that is disposed on the car door; and the transmission mechanism includes an unlocking lever that places the car-side latch in the unlocked state when the doorstop-side blade is displaced to the unlocked position.

* * * * *